US006831964B1

(12) United States Patent
Lazarev et al.

(10) Patent No.: US 6,831,964 B1
(45) Date of Patent: Dec. 14, 2004

(54) STOT-TYPE HIGH-INTENSITY X-RAY SOURCE

(75) Inventors: Pavel Ivanovich Lazarev, Moscow (RU); Oleg Valentinovich Komardin, Moscow (RU)

(73) Assignee: Quanta Vision, Inc., San Mateo, CA (US)

( * ) Notice: Subject to any disclaimer, the term of this patent is extended or adjusted under 35 U.S.C. 154(b) by 0 days.

(21) Appl. No.: 09/913,591

(22) PCT Filed: Feb. 4, 2000

(86) PCT No.: PCT/RU00/00035

§ 371 (c)(1),
(2), (4) Date: Aug. 16, 2001

(87) PCT Pub. No.: WO00/49637

PCT Pub. Date: Aug. 24, 2000

(30) Foreign Application Priority Data

Feb. 17, 1999 (RU) ..... 99103217

(51) Int. Cl.[7] ..... H01J 35/14
(52) U.S. Cl. ..... 378/138
(58) Field of Search ..... 378/138, 119, 378/121, 129, 130, 137, 139, 140

(56) References Cited

U.S. PATENT DOCUMENTS

| | | | | |
|---|---|---|---|---|
| 4,057,745 A | | 11/1977 | Albert | |
| 4,309,615 A | * | 1/1982 | Kowalski | 378/9 |
| 4,344,013 A | | 8/1982 | Ledley | |
| 4,903,287 A | * | 2/1990 | Harding | 378/119 |
| 5,175,757 A | | 12/1992 | Augustoni et al. | |
| 5,259,012 A | * | 11/1993 | Baker et al. | 378/21 |
| 5,768,337 A | * | 6/1998 | Anderson | 378/136 |
| 5,857,008 A | * | 1/1999 | Reinhold | 378/137 |

FOREIGN PATENT DOCUMENTS

| | | |
|---|---|---|
| DE | 24 41 986 | 3/1975 |
| DE | 35 43 591 | 6/1986 |
| RU | 2017261 | 7/1994 |
| RU | 2045132 | 9/1995 |
| WO | WO 96/29723 | 9/1996 |

* cited by examiner

*Primary Examiner*—Max Noori

(57) ABSTRACT

An x-ray radiation source in which a focused electron beam impinges upon a target positioned in front of the focal point of the electron beam and the radiation emitted by the target travels through the aperture of an aperture diaphragm with the aperture disposed at the focal point of the electron beam.

7 Claims, 3 Drawing Sheets

STOT-TYPE HIGH-INTENSITY X-RAY SOURCE

Figure 1:
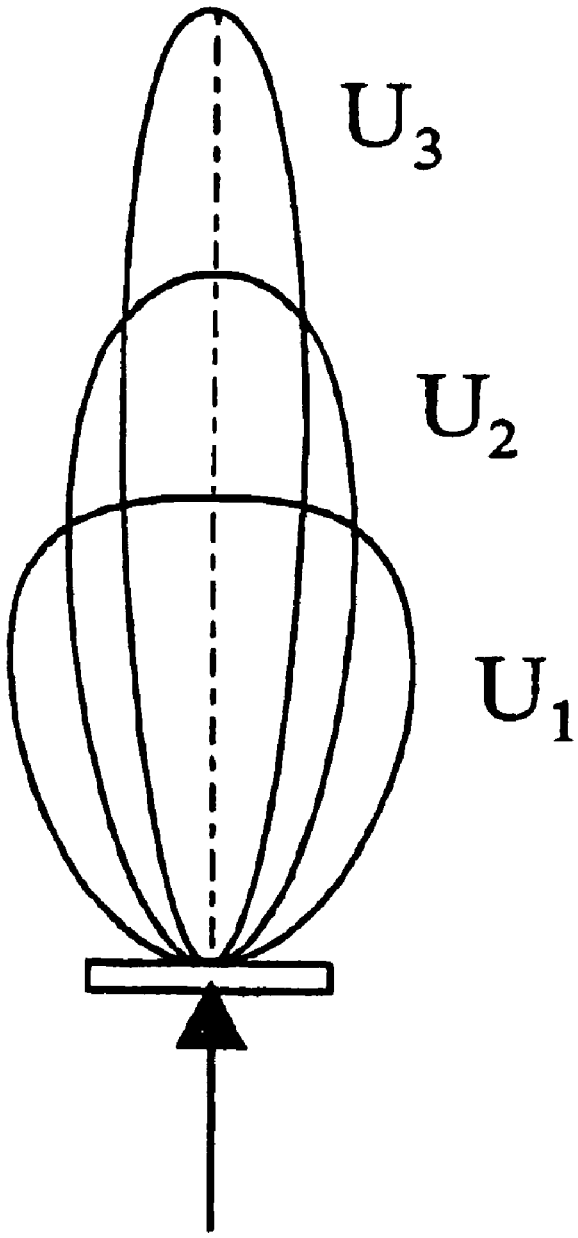

The proposed invention belongs to the class of X-ray sources allowing to obtain intensive X-ray radiation with small effective dimensions of the radiation emission region. The invention is intended to be used in X-ray microscopy, micro-defectoscopy, computer tomography, etc.

The X-ray radiation is known to be generated when an electron beam emitted by a cathode and accelerated by the electrode potential bombards an anode. When electrons decelerate in some material, X-ray radiation is generated. As investigation of X-ray radiation beam pattern emitted by an X-ray tube anode shows, the primary direction of the softer radiation component is perpendicular to the electron beam direction, while the direction of the harder component is close to that of the electrons falling onto the anode. As the applied voltage increases, the diagram of the X-ray radiation spatial distribution becomes more narrow-angled.

To either achieve high definition or to enlarge an image of the X-rayed object region (X-ray microscopy), radiation sources with small effective dimensions of the radiation emission regions, usually micro-focal X-ray tubes, are used. The target region out of which X-ray radiation is emitted when the target is bombarded by the electron beam is called the focus. The X-ray tubes in which the focus dimensions do not exceed several microns (or tens of microns) are called micro-focal. The focal spot dimensions are determined by the electron beam focusing extent, the target material, and the X-ray source design. The focal spot dimensions and the source radiation intensity that can be achieved are primarily dependent on the target material thermal resistance. Since a large amount of heat is released within a finite space when the electron beam decelerates in the target material, the target may be destroyed; this is the so-called thermal limit of the focal spot dimensions for the given specific load. On the other hand, the focal spot dimensions can not be made infinitely small due to electron scattering within the target material because this scattering increases the dimensions of the X-ray radiation emission region; this is the so-called electron limit. Increasing the tube radiation intensity, simultaneously making the focal spot dimensions smaller, is almost always a difficult task because the small focal spot dimensions do not allow to increase the electron beam intensity due to the target material destruction caused by release of great amount of heat. In certain X-ray tubes with 1-micron focal spots, the released power is about several hundredths of a Watt; the power is 0.6 Wt for 5-micron dimensions of the focal point. One more problem of manufacturing micro-focal X-ray tubes is to achieve the short focal distance, i.e. the distance between the X-ray tube focus and the X-ray radiation output window. To implement this, the tubes with transparent anodes are used. In these tubes, X-ray radiation is emitted from the target side opposite to the side of the electron beam incidence.

To make the anode focal spot small, the focusing accessories such as electrostatic, magnetic, and electromagnetic lenses are used; to decrease the thermal load on the anode focal spot with small dimensions, anode scanning by the electron beam is used as well as devices for anode rotation.

A micro-focal X-ray tube is known in prior art in which electrons emitted by the cathode are focused by the electron lenses into a point on the anode. The three-layer anode contains the target made of foil to generate X-ray radiation, the layer for electron deceleration, and the supporting substrate due to which the anode also serves as the X-ray-tube window. In this tube, the anode is transparent. To avoid anode damage at the point of electron beam incidence, the anode is connected to the engine providing anode rotation, so electrons fall onto different anode regions. (See Application PCT No. WO 96/29723, H01J 35/08, 35/24, publ. in 1996).

A high-power X-ray tube is described in the German patent No. 2441986, H01J 35/04, publ. in 1975. The tube is an evacuated chamber with the radiation output window, inside which an incandescent cathode is positioned as well as a transparent anode in the form of a cone, with the cone vertex directed towards the cathode. Electronic-optical accessories control the electron beam, thus providing uniform anode load.

In the German application No. 3543591 A1, H01J 35/22, publ. in 1986, a pulse micro-focal X-ray tube is described comprising the cathode, the electron lens to focus the electron beam, and the anode either transparent or massive and cooled, with a target to generate X-ray radiation. In this case, X-ray radiation comes out through a beryllium window at 90° angle with respect to the direction of the electron incidence.

The X-ray radiation source is also known which is the evacuated chamber with the window for X-ray radiation output, inside which the cathode and the anode are positioned. The source also contains the device directing the narrow electron beam to fall onto the anode and the deflecting device scanning the anode. The anode is transparent and has the following design: the target is a thin layer of a metal, for example, copper, deposited by vacuum spraying onto a thin substrate made of a metal with a relatively small atomic number, for example, aluminum. The plate made of a small-atomic-number material, for example, plastic, serves as a holder for the substrate; a multi-aperture cellular supporting structure is also present in the construction. Such design provides high transmission of X-ray radiation generated by the target. The chamber is placed into a collimating device allowing to properly shape the X-ray radiation beam (a source of this type is described in the U.S. Pat. No. 4,057,745, Cl. H01J 35/08, publ. in 1977). That technical solution is closest to the one proposed herein.

The invention purpose is to create the X-ray radiation source providing decrease of the radiation-emission region effective dimensions for sufficiently high radiation intensity and short focal distance.

The conventional methods in which the anode is scanned by the electron beam or rotated are not used to decrease the anode load. The electron beam is proposed to be focused behind the anode, and an X-ray-beam diaphragm is proposed to be positioned at the focus of the electron lens. As the defocused electron beam falls onto the anode, the anode radiation load decreases, thus allowing to increase the acceptable electric power. Due to X-ray radiation beam pattern formed for such geometry and to positioning the diaphragm at the electron lens focus, the obtained radiation is similar in its characteristics to that of a micro-focal source positioned at the location of the diaphragm and having the corresponding focal-spot dimensions.

The invention essence is that, in the well-known technical solution, which is an X-ray radiation source comprising an evacuated chamber with a window for X-ray radiation output and with an electron emitter and a transparent anode positioned in the window to generate X-ray radiation, at least one focusing electron lens, and a device shaping the X-ray radiation beam placed outside the chamber but attached to it, the anode is positioned before the electron lens focus along the electron beam path while the device shaping the X-ray radiation beam is a diaphragm, the center of which is placed at the focus of the electron lens.

To reduce the X-ray radiation losses, the anode can also serve as the X-ray-tube window. In this case, to increase the structural strength, the anode is implemented as a target made of metal foil deposited onto a substrate made of a small-atomic-number material with high heat conductivity. The anode may also be tightly vacuum-attached to the window for X-ray radiation output and positioned inside that window. The electron lens may have either a point or a dash-like focus, depending on problems to be solved. When the anode is the X-ray-tube window, the anode can be equipped with a cooling facility. The electron source used may be a pulse source.

The invention essence is explained by the following drawings:

FIG. 1, the beam pattern of radiation of the X-ray tube with the transparent anode is shown for different anode-cathode voltage values ($U_3>U_2>U_1$).

Figure 2:
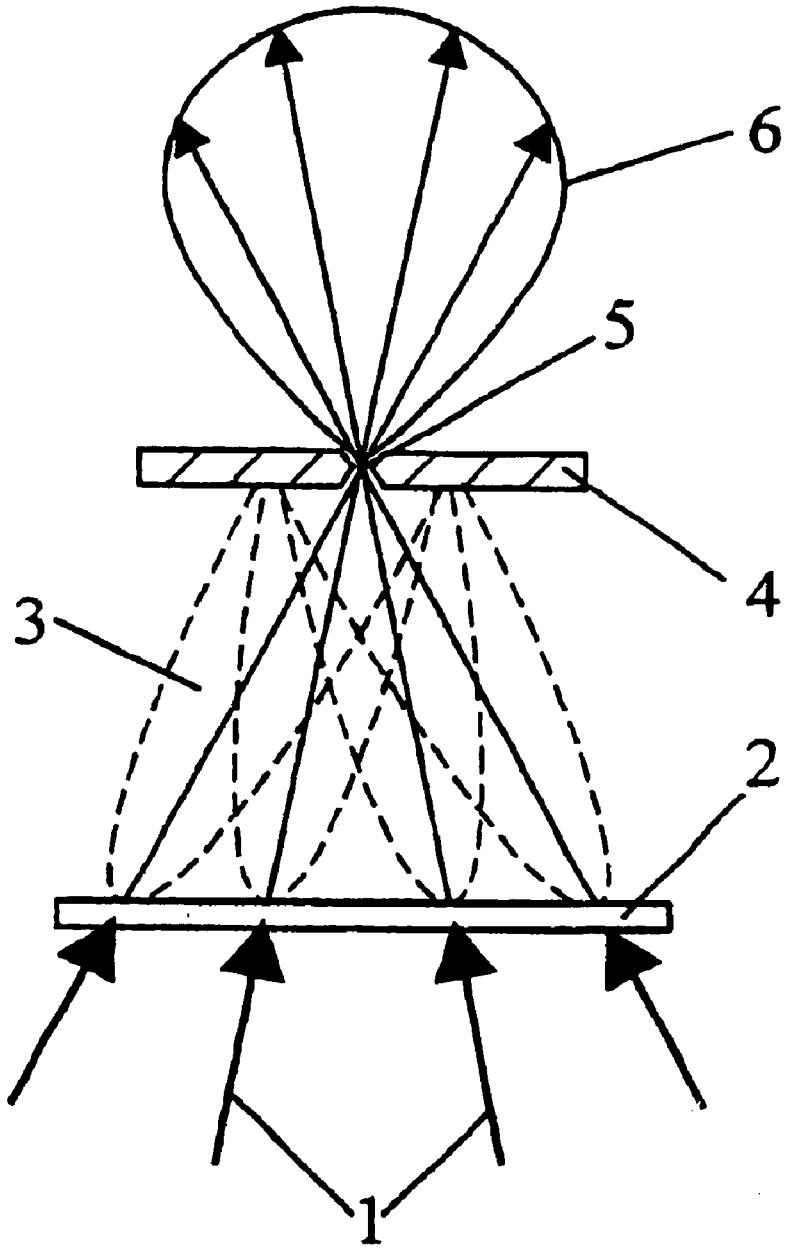

In FIG. 2, the direction of the electron beam incidence and the X-ray-radiation beam pattern for the proposed source are shown.

Figure 3:
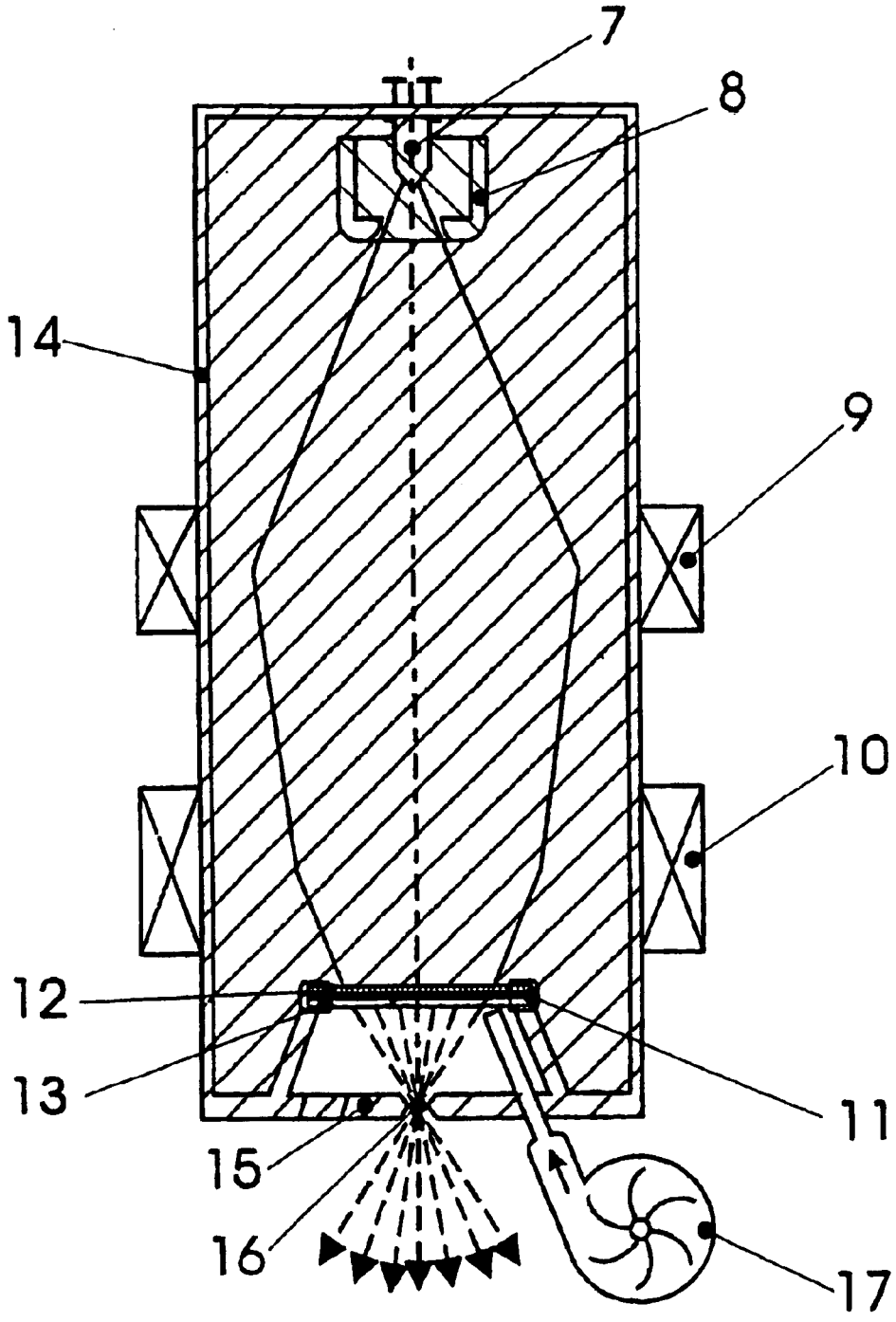

In FIG. 3, the layout overview for the proposed X-ray-radiation source is schematically presented.

FIG. 2 illustrates that the spatial distribution of radiation emitted by the proposed source is identical to that of radiation of a micro-focal source positioned at the location of the diaphragm, with the anode ray load reduced (the beam is defocused on the target). This figure shows the electron beam 1 that falls onto the target 2 that generates X-ray radiation 3 converging towards the diaphragm 4, the aperture of which is placed at the electron lens focus (not shown in this drawing). Item 6 indicates spatial distribution of X-ray radiation at the output of the proposed source.

Consider operation of the device shown in FIG. 3. Electrons emitted by the cathode 7 (e.g. a thermocathode; however, this is not essential) are shaped by the focusing cap into a beam and are focused by the electron lenses 9 and 10 on the anode 11, which is the target 12 made of metal foil deposited onto the substrate 13 made of small-atomic-number material (the target can be deposited onto the substrate by vacuum spraying). The substrate provides the structural strength and heat removal and can be conveniently fixed to the source chamber so as the anode can also serve as the window for X-ray radiation output. However, the anode made of foil can be used without the substrate. In this case, the chamber is supplied with a beryllium window for X-ray radiation output (not presented in the drawing). The anode and the cathode are positioned within the evacuated chamber 14. The diaphragm 15 shaping the X-ray radiation beam is positioned outside the chamber and behind the anode. The diaphragm can be attached to the source chamber 14. The center 16 of the diaphragm 15 must be placed at the focus of the electron lens 10. The electron lens 10 can have either a point or a dash-like focus, depending on the problems to be solved using the equipment in which the proposed X-ray radiation source is implement. When the anode is the source output window, it may be equipped with the cooling facility 17.

What is claimed is:

1. An x-ray radiation source comprising an evacuated chamber with a window for x-ray radiation output, in which an electron emitter and a transparent anode are positioned to generate x-ray radiation, at least one focusing electron lens, and a device shaping the x-ray radiation beam placed outside the chamber but attached to it, wherein the anode is positioned before a focus of said electron lens along the electron beam path and wherein the device shaping the x-ray radiation beam is an aperatured diaphragm, the center of said aperature being placed at the focus of said electron lens.

2. An x-ray radiation source of claim 1, wherein the anode is a target made of metal foil deposited onto a substrate made of a small-atomic-number material.

3. An x-ray radiation source of claim 1 wherein the anode is tightly vacuum-attached to the window for x-ray radiation output and positioned inside that window.

4. An x-ray radiation source of claim 3, wherein the anode is equipped with a cooling facility.

5. An x-ray radiation source of claim 1, wherein the electron lens has a point focus.

6. An x-ray radiation source of claim 1, wherein the electron lens has a dash-like focus.

7. An x-ray radiation source of claim 1, wherein the electron source used is a pulse source.

* * * * *